United States Patent [19]

Tungett

[11] Patent Number: 5,014,942

[45] Date of Patent: May 14, 1991

[54] MEANS FOR HYGIENICALLY POSITIONING AN OUTLET OF AN APPLIANCE INDIRECT DRAIN CONDUIT

[76] Inventor: Ronald L. Tungett, 4891 SW. 64 Way, Davie, Fla. 33314

[21] Appl. No.: 409,656

[22] Filed: Sep. 15, 1989

[51] Int. Cl.[5] ..... A62C 23/04

[52] U.S. Cl. ..... 248/79; 285/12; 285/64

[58] Field of Search ..... 285/12, 61, 64; 248/79

[56] References Cited

U.S. PATENT DOCUMENTS

| | | | |
|---|---|---|---|
| 1,493,498 | 5/1924 | Pluym | 246/79 |
| 1,914,780 | 6/1933 | Lichamer | 285/12 X |
| 2,591,427 | 4/1952 | Harkey | 248/79 |
| 2,592,053 | 4/1952 | Megla | 248/79 |
| 4,318,519 | 3/1982 | Blevins | 248/79 |

FOREIGN PATENT DOCUMENTS

| | | | |
|---|---|---|---|
| 965068 | 5/1957 | Fed. Rep. of Germany | 248/79 |

*Primary Examiner*—Dave W. Arola
*Attorney, Agent, or Firm*—Melvin K. Silverman

[57] ABSTRACT

An adaptor is set forth for assuring a hygienic position of the outlet of an appliance indirect drain conduit relative to an input of a hub drain.

15 Claims, 5 Drawing Sheets

MEANS FOR HYGIENICALLY POSITIONING AN OUTLET OF AN APPLIANCE INDIRECT DRAIN CONDUIT

BACKGROUND OF THE INVENTION

It is known that fixtures, appliances and devices not regularly classified as plumbing fixtures may be drained by indirect means if they are provided with drip or drainage outlets. Appliances of this type include refrigerators, ice boxes, bar sinks, automatic ice makers, drinking fountains, cooling or refrigerating coils, laundry washers, extractors, steam tables, egg boilers, coffee urns, stills, sterilizers, water stations, water lifts, expansion tanks, cooling jackets, drip or overflow pans, air conditioning condensate drains, drains from overflows, and relief vents from the water supply system.

Such indirect drainage, which is almost universally required in building codes within the United States, is intended to prevent bacteria from backing-up from sewage lines into these special fixtures and from contaminating their contents. For example, overflow and relief pipes on expansion tanks, such as sprinkler systems, and cooling jackets must always be indirectly connected to the sanitary drainage system. This avoids the possibility of a cross-connection which would contaminate the potable water supply system. A positive separation by indirect means, i.e., a physical distance between the waste drain inlet and the indirect drainage outlet of appliances of the above type and of hospital equipment.

The so-called indirect method of piping is unique and is most practical for fixtures with low discharge rates. While some building codes do not require specified horizontal lengths for indirect waste piping, others impose a maximum length of fifteen feet. Also, the required positive separation between the appliance fixture outlet and the waste drain input typically varies between one inch and two inches. The basic problem in indirect waste piping is that the horizontal length of the piping, in combination with the gravity vector, gives rise to a moment of rotation of the outlet piping of the indirect drain. Thereby, over time, the indirect waste piping exhibits a tendency to droop, in some instances to the point that the required positive separation between the outlet of the indirect waste piping and the drainage inlet is compromised. This, for the reasons above set forth above can pose a serious hazard to the contents of the consumer or hospital appliance or the type enumerated above. It is accordingly, in response to this problem that the present invention is directed.

To the knowledge of the inventor, the hereinafter set forth response to the above problem is completely novel.

SUMMARY OF THE INVENTION

The instant invention relates to a means for ensuring a hygienic position of an outlet of an appliance indirect drain conduit relative to an input of a hub drain of a waste drain system. The invention more particularly includes a lower circumferential fitting proportioned for complemental engagement with said input of said hub drain. Further included is an upright support element having an elongate axis substantially parallel with the gravity vector, said upright support element having an upper end and a lower end, said lower end rigidly depending from said lower circumferential fitting. The hygienic positioning means yet further includes an upper circumferential fitting having a fluid input and a fluid output, said input proportioned for complemental engagement with said outlet of said appliance indirect drain conduit, said output of said upper circumferential fitting having an axis disposed substantially parallel to the gravity vector and within an imaginary cylinder defined by said hub drain, in which said fluid input of said upper circumferential fitting is rigidly secured to said upper end of said upper circumferential fitting at a height above the level of the input to said hub drain substantially determined by the length of said elongate axis of said upright offset element. Thereby, the possibility of bacterial cross-contamination between said appliance indirect drain conduit and said hub drain is thereby minimized.

It is accordingly an object of the present invention to provide a means for assuring that the output of an appliance indirect drain conduit will not become bacterially contaminated with an input to a hub drain of a waste drainage system.

It is another object of the present invention to provide a practical and cost effective adaptor for effecting the above objective.

It is a further object of the present invention to provide means of the above type that will facilitate compliance with applicable building and health codes at a minimum of cost to indirect drain appliance owners.

The above and yet other objects and advantages of the present invention will become apparent in the hereinafter set forth Brief Description of the Drawings, Detailed Description of the Invention, and Claims appended herewith.

DETAILED DESCRIPTION OF THE INVENTION

Figure 1:
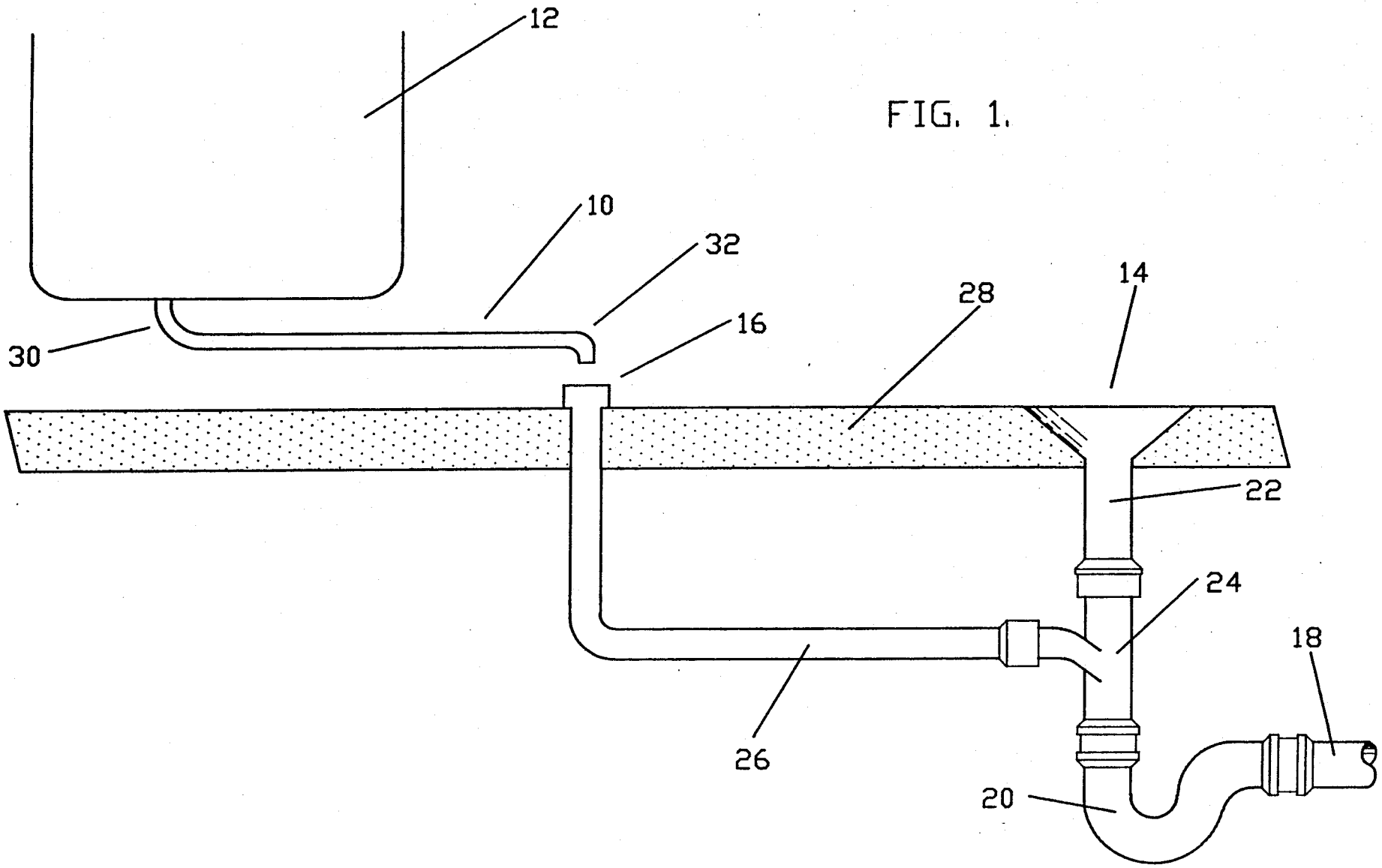
FIG. 1 is a representational view showing the relationship between an indirect waste drain conduit, a floor drain, and an indirect waste hub drain.

With reference to the view of FIG. 1, there is shown in representational view the relationship between an indirect waste drain 10 of an indirect drainage appliance 12 (of type set forth in the Background of the Invention), a standard floor drain 14 and an indirect hub drain 16. As may be noted in FIG. 1, the floor drain 14 connects to the general sewerage line 18 through trap 20 and conduit 22 through coupling 24, and indirect waste pipe 26 connects to hub drain 16, passing through floor 28.

As may be noted from the horizontal length of indirect drain pipe 10, the elbow 30 is subjected to a substantial moment of rotation. Accordingly, even when pipe 10 is secured, either to appliance 12 or floor 28, there will exist a tendency, over time, for pipe 10 to droop in a clockwise direction such that its outlet 32 will approach, and often touch, the entrance to hub drain 16.

Figure 2:
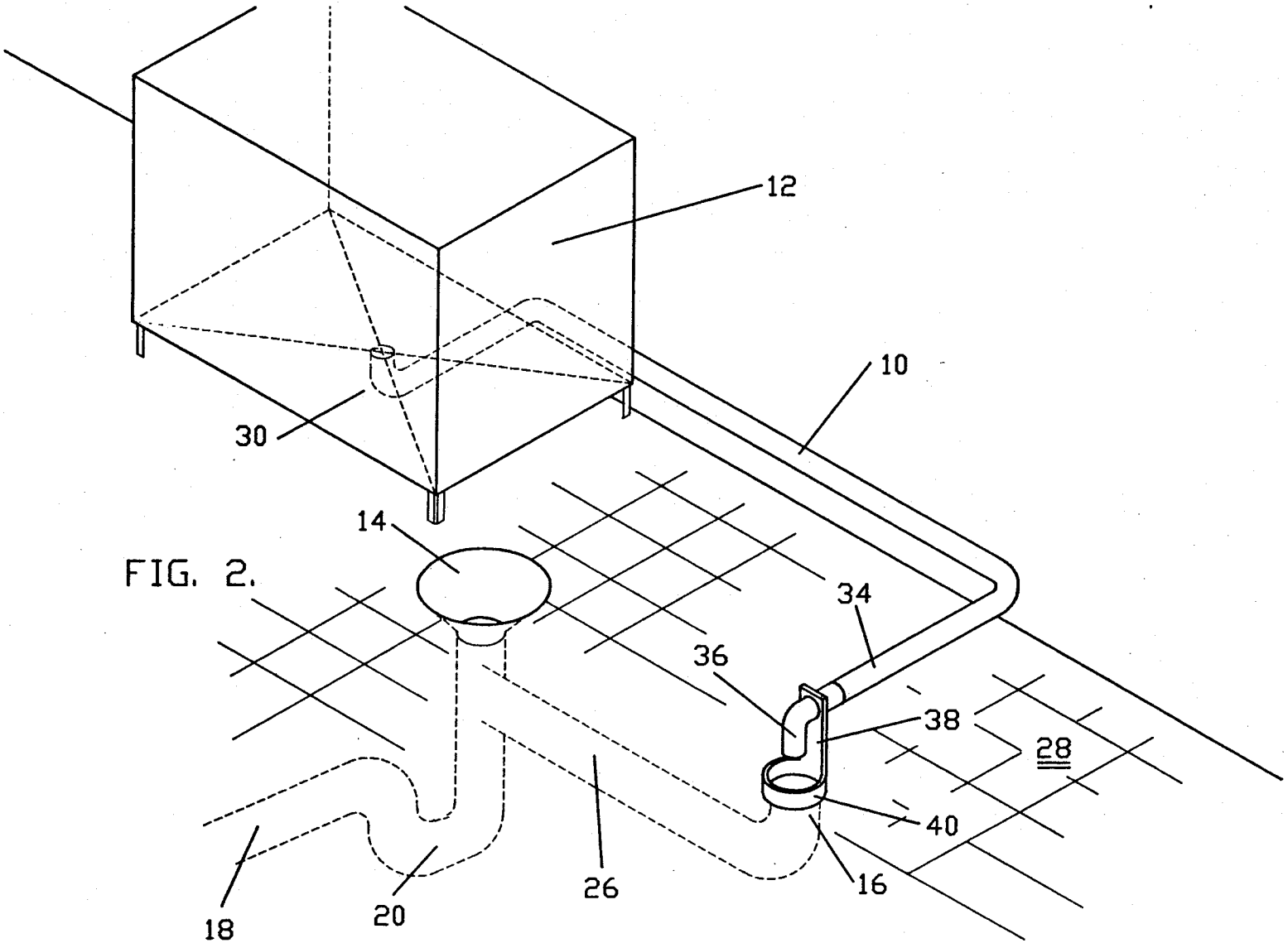
FIG. 2 is a schematic view showing typical positions of an indirect drain pipe relative to an indirect drain appliance.
Figure 4:
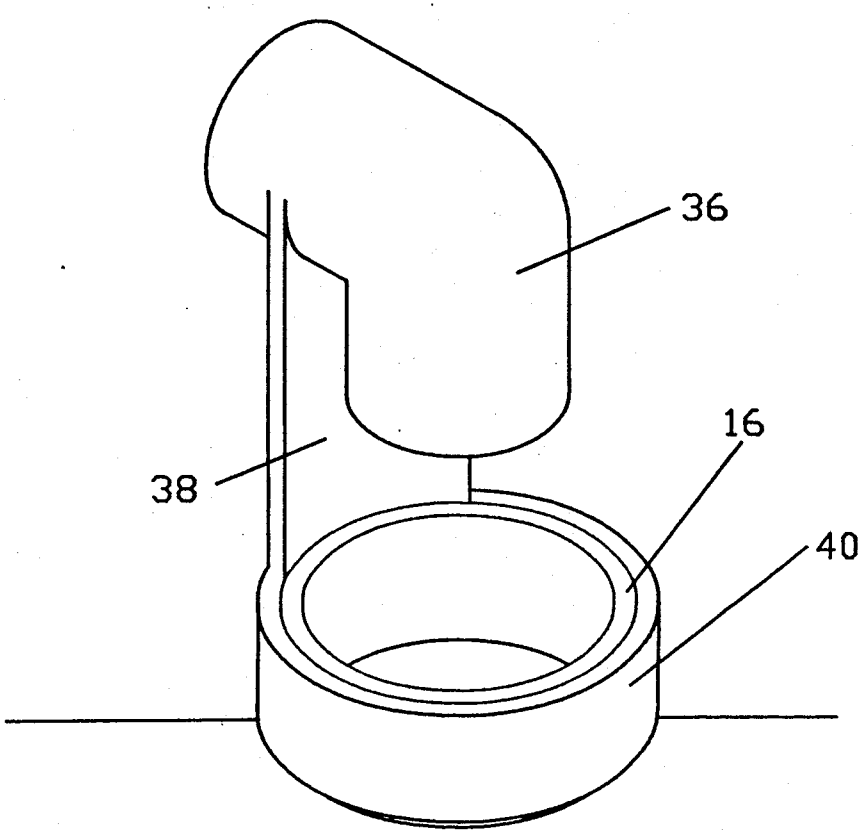
FIG. 4 is an assembly view of the instant invention.
Figure 3:
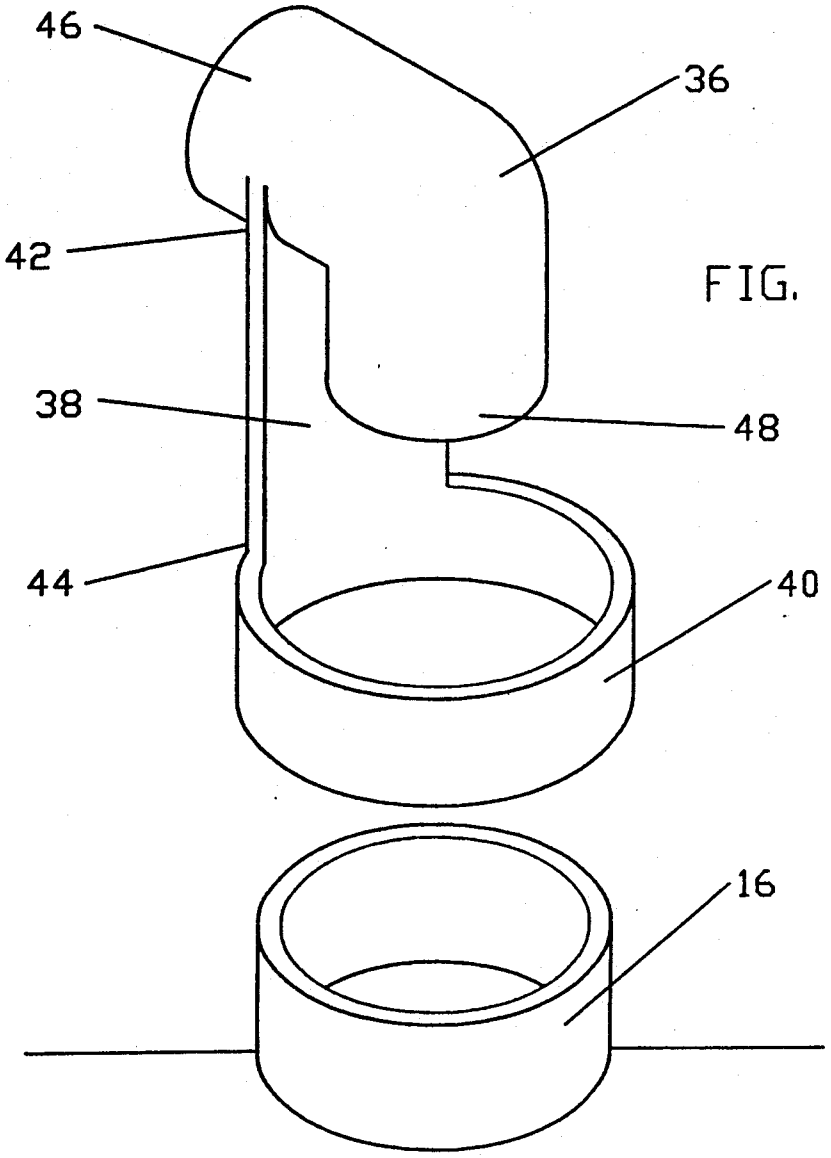
FIG. 3 is an exploded view of the instant invention.

In the views of FIGS. 2 thru 4, the instant invention is seen to comprise a means for ensuring a hygienic position of the outlet 32 of an appliance drain pipe 10 relative to the input of the hub drain 16 of the general wastage line 18. More particularly, there is shown in FIG. 2 a typical arrangement in which the length of the indirect drain pipe 10 is even longer than that shown in FIG. 1. In such a situation, even more opportunity exists for the pipe 10 to droop downward causing the output thereof to approach the hub drain 16. In the practice of the instant invention, said outlet 32 (See FIG. 1) of the indirect drain pipe 10 is cut to a clean radial cross-sectional end 34 which is shown in FIG. 2. To said radial cross-sectional end 34 is applied an upper circumferential fitting 36 which is suspended above the level of floor 28 by an upright support element 38 which depends integrally from a lower circumferential fitting 40 which is proportioned for complemental engagement with the input of said hub drain 16. The inventive means is shown in exploded, view relative to the hub drain, in FIG. 4. It may assembled view, relative to the hub drain, in FIG. 4. It may be noted that said upright support element 38 exhibits an elongate axis which is substantially parallel with the gravity vector, and that said upright support element 38 exhibits an upper end 42 and a lower end 44, said lower end rigidly integrally depending from said lower circumferential fitting 40.

Said upper circumferential fitting 36 includes a fluid input 46 and a fluid output 48, said input being proportioned for complemental engagement with said radial cross-sectional end 34 of indirect drain pipe 10.

As may be noted in FIGS. 3 and 4, said output 48 of the upper circumferential fitting 36 exhibits an axis which is disposed substantially parallel to the gravity vector and is within an imaginary cylinder defined by said hub drain 16. Thereby, said fluid output 48 of said upper circumferential fitting 36 is rigidly secured at upper end 42 of said upright offset element 38 at a height above the level of the hub drain 16 which, accordingly, will be determined by the vertical length of said upright support element 38.

In most building/health codes, the length of said axis of said upright support element 38 will be between one and two inches. Further, it is to be appreciated that the diameter of output 48 of upper circumferential fitting 36 will often be substantially less than is shown in the figures. However, for purposes of clarity of explanation of the invention, an enlarged diameter of fluid output 48 of upper circumferential fitting 36 has been shown.

The primary consequence of the instant invention is that the outlet 34 of indirect drain pipe 10 will be maintained, at all times, at a prescribed height above hub drain 16, regardless of any support or drooping problems which the indirect drain pipe 10 may have between the location of the appliance 12 and the hub drain 16.

Figure 6:
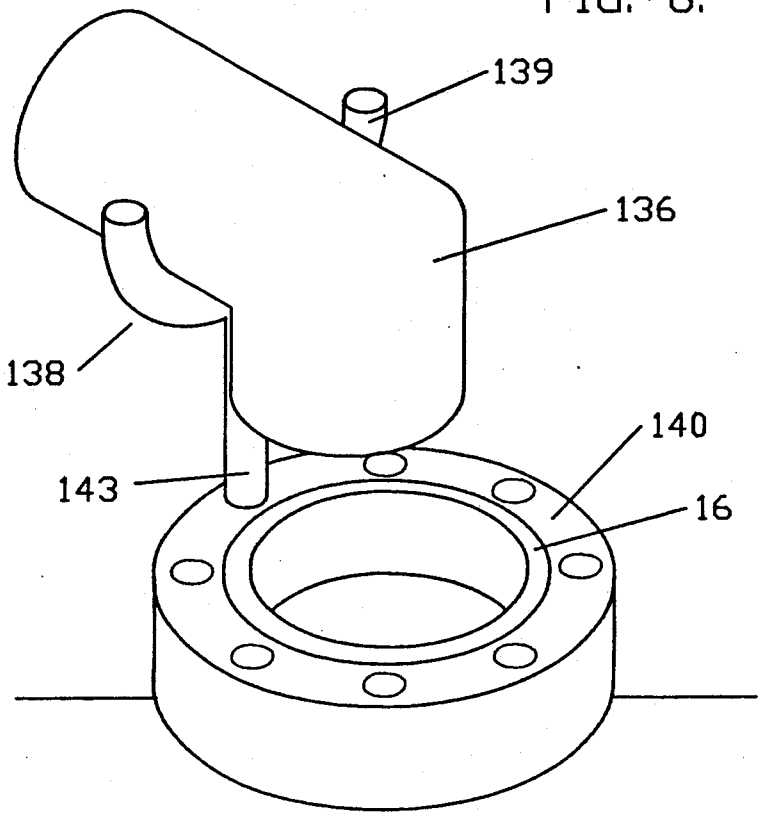
FIG. 6 is an assembly view of the embodiment of FIG. 5.
Figure 5:
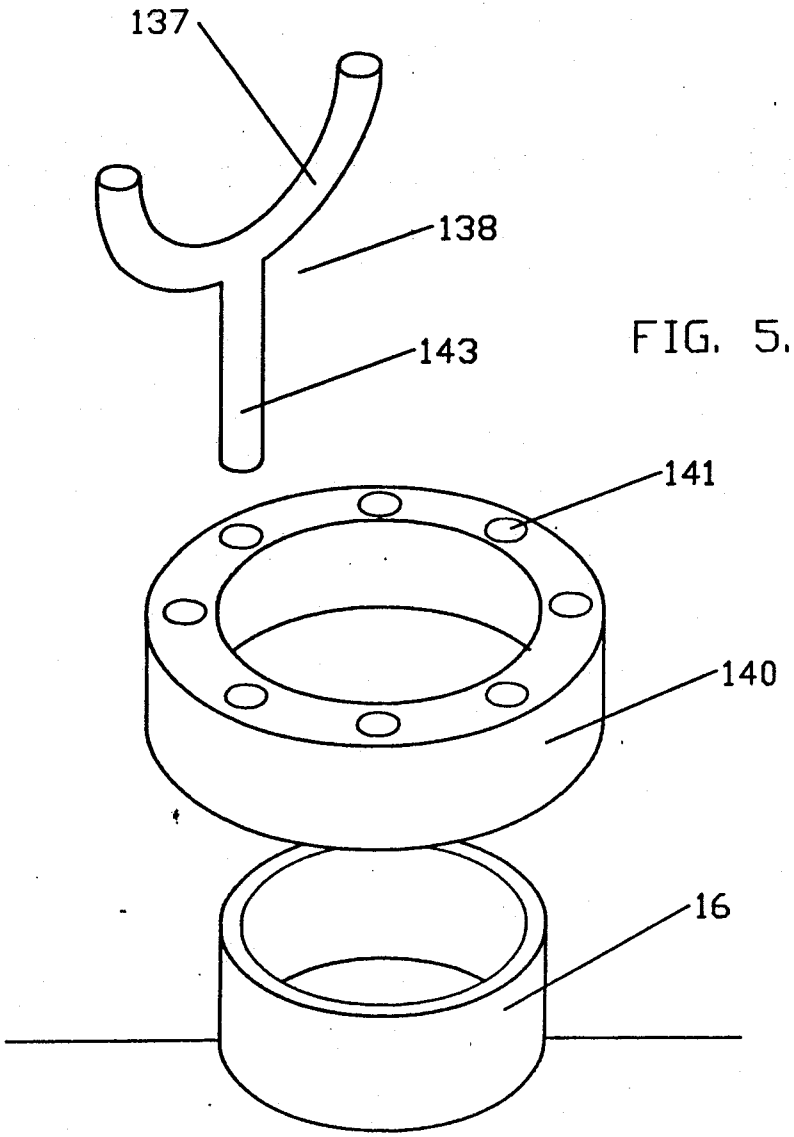
FIG. 5 is an exploded view of a second embodiment of the instant invention.

A further embodiment of the instant invention is shown in the views of FIGS. 5 and 6, therein, it may be noted that the upright element 38 of the embodiment of FIGS. 2 thru 4, is replaced by an element 138 having an U-shaped upper end 139 and a vertical linear lower end 143. Further, in the embodiment of FIGS. 5 and 6, said lower circumferential fitting 40 is replaced by a circumferential fitting 140 provided with a circumferential plurality of polarly disposed recesses 141. The exploded view of FIG. 5, when assembled, appears as in the view of FIG. 6. Therein, it may be appreciated that the U-shaped portion 139 of element 138 holds the upper circumferential fitting 136 at the desired height relative to hub 16, while vertical element 143 assures that U-shaped element 139 will remain stable relative to lower circumferential fitting 140.

Figure 7:
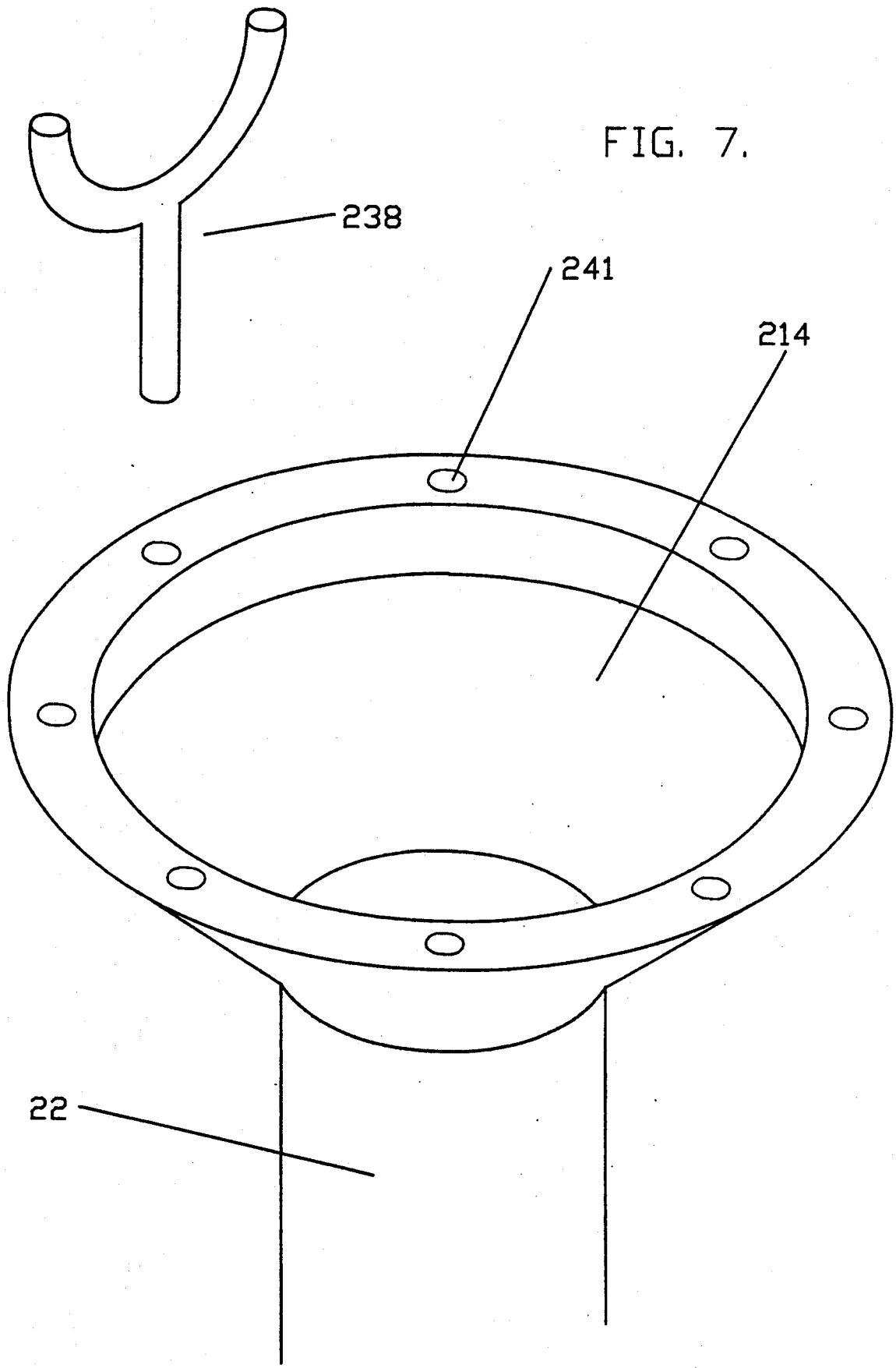
FIG. 7 is a perspective view of a third embodiment of the invention.

In the view of FIG. 7 is shown a further embodiment in which a drain 214 is provided with polarly disposed recesses 241 which are proportioned to receive the bottom of U-shaped element 238.

As may be appreciated, a benefit of the instant invention lies in the fact that a plumber may work from the drain 16 backward to the appliance 12. This is not possible in the prior art.

Accordingly, while there has been shown and described the preferred embodiment (the embodiments of FIGS. 2 thru 4) of the instant invention, it is to be appreciated that the invention may be embodied otherwise than is herein specifically shown and described and that within said embodiments certain changes may be made within the form and arrangement of the parts without departing from the underlying ideas or principles of this invention within the scope of the Claims appended herewith.

Having thus described my invention, what I claim as new, useful and non-obvious and, accordingly, secure by Letters Patent of the United States is:

1. A means for hygienically positioning an outlet of an appliance indirect drain conduit, relative to an input of a drain, said positioning means comprising:

(a) a lower circumferential fitting proportioned for circumferential engagement with said input of said drain;

(b) an upright support element having an elongate axis substantially parallel with the gravity vector, said axis having a length said support element having an upper end and a lower end, said lower end projecting integrally upwardly from said lower circumferential fitting;

(c) an upper circumferential fitting having a fluid input and a fluid output, said input proportioned for complemental engagement with said outlet of said appliance indirect drain conduit, said output of said upper circumferential fitting having an axis disposed substantially parallel to the gravity vector and within an imaginary cylinder defined by the drain, in which said fluid output of said upper circumferential fitting is rigidly secured at said upper end of said upright support element at a height above the level of said drain, said height determined by the length of said elongate axis of said upright support element, whereby the possibility of bacterial communication between said appliance indirect drain conduit and said drain thereby minimized.

2. The means recited in claim 1 in which said lower circumferential fitting is integral with said upright support element, and said upright support element is integral with said upper circumferential fitting.

3. The means as recited in claim 2 in which the elongate axis of said upright element is less than three inches.

4. The means as recited in claim 2 in which said drain comprises a hub drain.

5. The means recited in claim 1 in which said upright support element is selectably radially positionable relative to said lower circumferential fitting.

6. The means recited in claim 5 in which said upper circumferential fitting and said lower circumferential fitting are both selectively positionable relative to said drain.

7. The means recited in claim 5 in which said upright element is polarly re-positionable relative to said lower circumferential element.

8. The means recited in claim 5 in which said upper element comprises a first element having a U-shaped upper end for engagement with said upper circumferential fitting.

9. The means as recited in claim 5, in which the elongate axis of said upright element is less than three inches.

10. The means as recited in claim 9 in which said lower circumferential fitting comprises said input to said drain.

11. The means as recited in claim 5 in which said lower circumferential fitting comprises said input to said drain.

12. The means as recited in claim 5 in which said drain comprises a hub drain.

13. The means as recited in claim 12 in which said upper lower circumferential fitting and said lower circumferential fitting are both selectively positionable relative to said hub drain.

14. The means as recited in claim 12 in which said upright element is polarly re-positionable relative to said lower circumferential element.

15. The means as recited in claim 12 in which said upright element comprises a first element having an U-shaped upper end for engagement with said upper circumferential fitting.

* * * * *